US008297183B2

(12) United States Patent
Hörster et al.

(10) Patent No.: US 8,297,183 B2
(45) Date of Patent: Oct. 30, 2012

(54) ROLLER PRESS WITH DISPLACEABLE HEAD ELEMENTS

(75) Inventors: Nils Hörster, Dortmund (DE); Helmut Lücke, Beckum (DE); Silvio Lorenz, Ennigerloh (DE)

(73) Assignee: Thyssenkrupp Polysius Aktiengesellschaft, Beckum (DE)

( * ) Notice: Subject to any disclaimer, the term of this patent is extended or adjusted under 35 U.S.C. 154(b) by 290 days.

(21) Appl. No.: 12/666,193

(22) PCT Filed: Jun. 16, 2008

(86) PCT No.: PCT/EP2008/057562

§ 371 (c)(1),
(2), (4) Date: Dec. 22, 2009

(87) PCT Pub. No.: WO2009/007197

PCT Pub. Date: Jan. 15, 2009

(65) Prior Publication Data

US 2010/0186607 A1 Jul. 29, 2010

(30) Foreign Application Priority Data

Jul. 9, 2007 (DE) ..... 10 2007 031 879

(51) Int. Cl.
*B30B 3/04* (2006.01)

(52) U.S. Cl. ..... 100/176; 100/168

(58) Field of Classification Search ..... 100/168, 100/169, 176; 72/238; 241/227, 232, 285.2; 425/237

See application file for complete search history.

(56) References Cited

U.S. PATENT DOCUMENTS

| | | | | |
|---|---|---|---|---|
| 3,845,708 | A * | 11/1974 | Liebert | 100/155 R |
| 3,899,965 | A * | 8/1975 | Koch et al. | 100/155 R |
| 4,395,944 | A * | 8/1983 | Siepermann et al. | 100/168 |
| 6,786,144 | B2 * | 9/2004 | Williams | 100/168 |
| 7,451,945 | B2 | 11/2008 | Wollenhaupt et al. | |

FOREIGN PATENT DOCUMENTS

| | | | |
|---|---|---|---|
| DE | 202004001187 | U1 | 2/2005 |
| WO | WO-2007033800 | A1 | 3/2007 |

* cited by examiner

*Primary Examiner* — Jimmy T Nguyen
(74) *Attorney, Agent, or Firm* — Gifford, Krass, Sprinkle, Anderson & Citkowski, P.C.

(57) ABSTRACT

The invention relates to a roller press having two rollers rotatably supported in a frame. In order to mount or dismount the rollers, at least one head piece of the frame can be removed from its operating position by being displaced outwards in the transverse direction. Such an embodiment is distinguished by inexpensive manufacture of the roller press and a time-saving mounting and dismounting of the rollers.

14 Claims, 2 Drawing Sheets

ROLLER PRESS WITH DISPLACEABLE HEAD ELEMENTS

RELATED APPLICATIONS

This is a 35 U.S.C. 371(c)(2) application of PCT/EP2008/057562 filed on Jun. 16, 2008, which claims priority to German Application 10 2007 031 879.2 filed on Jul. 9, 2007, both of which are included in their entirety herein by reference.

FIELD OF THE INVENTION

The invention relates to a roller press having two rollers, and in particular, to a roller press having two rollers with at least one head piece that is removable from its operating position while continuing to support upper flanges of an upper frame portion in order to mount or dismount the rollers and the removable head piece is outwardly displaceable transversely to the upper flanges of the upper frame portion.

BACKGROUND OF THE INVENTION

The high pressure forces occurring in the roller gap during the operation of such roller presses or material bed roller mills have to be absorbed by the frame of the roller press. The upper flanges of the upper frame portion are for that purpose connected by way of head pieces (pressure beams) to the lower frame portion to form a closed rigid frame.

If, after a specific operating time, the rollers of such roller presses are to be replaced or serviced, the rollers have to be removed from the frame of the roller press. The closed rigid frame of the roller press must for that purpose be opened to such an extent that the rollers with their bearing shoes can be removed through one end of the frame. Normally, this opening of the frame occurs at the end that is adjacent to the fixed roller because the pressure system for generating the roller pressure is located between the head pieces of the other end and the loose roller.

Various proposed solutions are already known for opening the frame at one end in order to mount or dismount the rollers. During that process, the head pieces of that end are removed from their operating position.

In the roller press according to DE 20 2004 001 187 U1, the head pieces can for that purpose be folded downwards about an axis of rotation which extends horizontally and parallel with the roller axis, it being possible to use them in the lower end position as rails for moving the roller units out. In the operating position, the head pieces are connected at their upper and lower end by bolts to the upper and lower frame portion, respectively. Since those bolts lie entirely within the force flow of the closed frame, they are exposed to severe stresses and have to be designed to be very sturdy. At the same time, however, those bolts are subject to a very narrow tolerance which means that manufacturing costs are high. Another disadvantage of this known embodiment is that the upper frame portion, when no longer supported by the downwardly folded head pieces, has to be held in position by additional auxiliary means.

In the roller press according to WO 2007/033800 A1, the two head pieces are, at the end of the frame that is adjacent to the fixed roller, pivotable upwards and outwards about horizontal pivot axes which extend in a cross-frame of the upper flange perpendicularly to the roller axes. The upper frame portion is held in position by a permanently mounted additional frame, which involves considerable extra cost.

A roller press, that has the head pieces, which can be removed from their operating position, can be pivoted outwards about vertically extending axes, and they continue to support the upper frame portion even in the position in which they are pivoted out is also known from practice. Additional auxiliary means for holding the upper frame portion are therefore unnecessary when the rollers are to be mounted or dismounted.

However, that known embodiment too is still encumbered with the disadvantage described above that the pivot bolts of the head pieces are subjected to severe stresses during operation and therefore have to be manufactured at the same time sturdily and with a narrow tolerance.

The object of the invention is therefore to avoid the shortcomings of the known embodiments and to develop a roller press in such a manner that inexpensive manufacture results and the mounting and dismounting of the rollers can be carried out in a time-saving and simple manner.

SUMMARY OF THE INVENTION

The object of the invention is achieved by a roller press having two rollers which are rotatably supported in a frame which has a lower frame portion, an upper frame portion formed by two upper flanges, and at the two ends of the frame, head pieces for connecting the upper frame portion to the lower frame portion. One of the rollers is supported in a non-displaceable manner as a fixed roller and the other roller is displaceable as a loose roller in a direction towards the fixed roller by means of a pressure system and pressure forces occurring during the operation of the roller press being absorbed by the upper and lower frame portions via the head pieces. At least one head piece is removable from its operating position while continuing to support the upper flanges of the upper frame portion in order to mount or dismount the rollers and the removable head piece is outwardly displaceable transversely to the upper flanges of the upper frame portion.

Owing to the fact that the invention dispenses with a rotatable connection between the removable head piece and the upper and lower frame portion, it avoids the disadvantages described above associated with a head piece pivot bolt lying in the full operational force flow. The head piece which is outwardly displaceable according to the invention transversely to the upper flange of the frame can, in the operating position, be connected in a structurally simple manner rigidly to the upper and lower frame portion. In the outwardly displaced position, the head piece continues to support the upper frame portion, so that no additional auxiliary means are necessary for the purpose.

BRIEF DESCRIPTION OF THE DRAWINGS

Advantageous configurations of the invention are the subject-matter of the subordinate claims and are explained in connection with the description of an embodiment illustrated in the drawings.

In the drawings

DETAILED DESCRIPTION OF THE INVENTION

Figure 1:
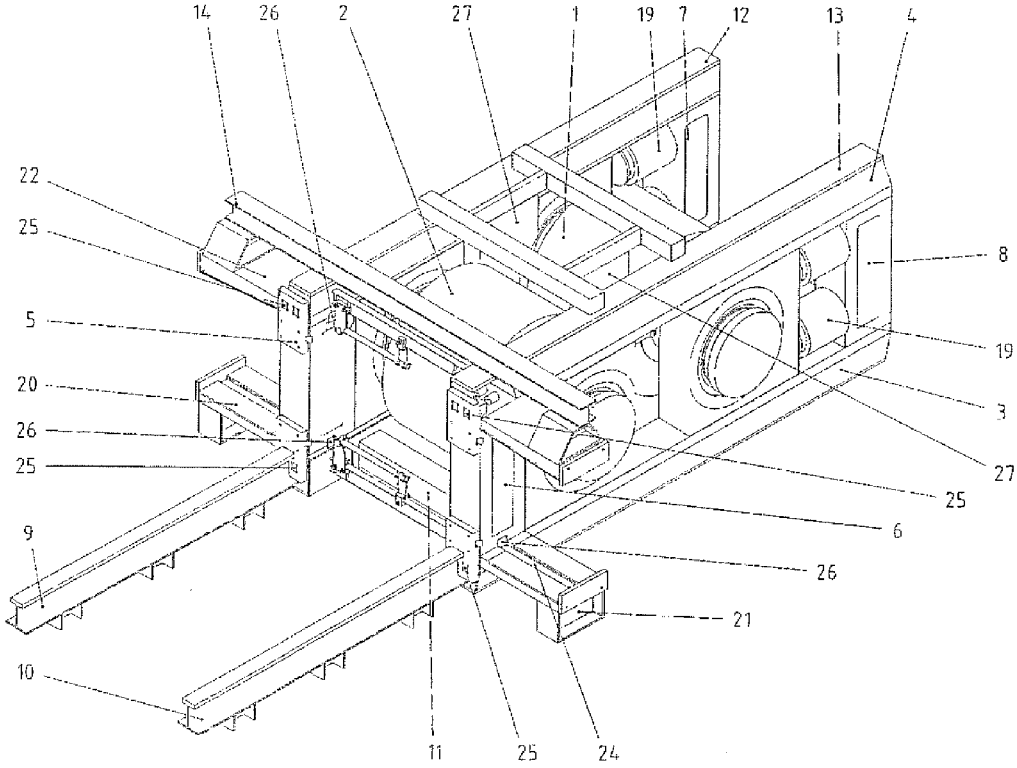
FIG. 1 is a perspective diagrammatic view of a roller press according to the invention in the operating state.

The roller press according to FIG. 1 contains two rollers, 1,2 which are rotatably supported in a frame. The frame basically comprises a lower frame portion 3, an upper frame portion 4 and two pairs of head pieces 5,6 and 7,8, respectively, which, at the two ends of the frame, connect the lower frame portion 3 to the upper frame portion 4.

The lower frame portion 3 comprises two lower flanges 9, 10 and a transverse flange 11 connecting those lower flanges at the one end of the frame. The upper frame portion 4 comprises two upper flanges 12, 13 and a cross-beam 14 connecting those upper flanges at the one end of the frame.

The rollers 1,2 are supported with their two shaft ends in bearing shoes 15, 16 and 17, 18, respectively, which are each arranged between a respective lower flange 9, 10 of the lower frame portion 3 and a respective upper flange 12, 13 of the upper frame portion 4.

In the operating position of the roller press (FIG. 1), the bearing shoes 15, 16 of the roller 2 (fixed roller) are supported at the head pieces 5, 6 of the frame. The roller 1 (loose roller) is forced in the direction towards the roller 2 by a pressure system formed by four pressure cylinders 19, and this generates the high grinding pressure necessary for material bed comminution in the roller gap between the two rollers 1, 2. The head pieces 5 to 8 form pressure beams which introduce the grinding forces into the lower flanges 9, 10 and upper flanges 12, 13 of the frame.

Figure 2:
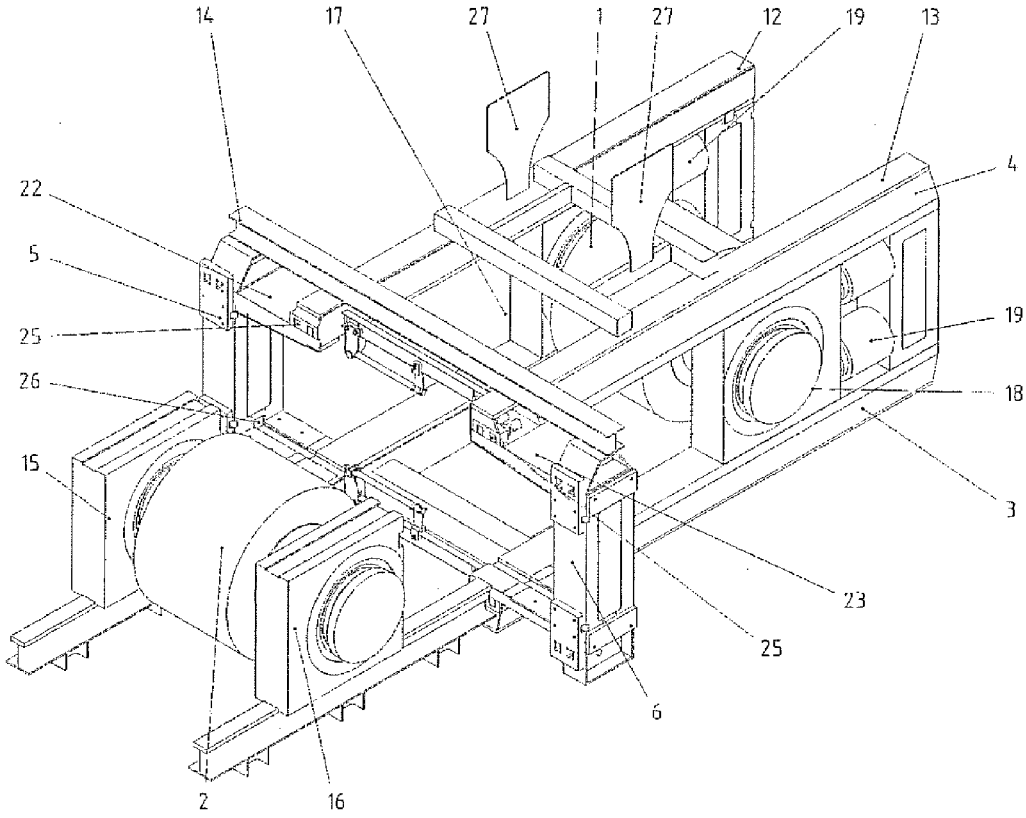
FIG. 2 shows the roller press according to FIG. 1 during the removal of the rollers from the frame.

In order to replace the rollers 1, 2 or to remove them periodically from the frame for servicing, the head pieces 5, 6 at the end of the frame that is adjacent to the fixed roller (roller 2) can be displaced from their operating position (FIG. 1) outwards into an opening position (FIG. 2).

For that purpose, the lower frame portion 3 and the upper frame portion 4 have projecting slide rails 20, 21 and 22, 23, respectively, at the end of the frame that contains the displaceable head pieces 5, 6.

The slide rails 20, 21 connected to the lower flanges 9, 10 of the lower frame portion 3 contain a guide 24 in the form of a groove for the displaceable head pieces 5, 6.

The slide rails 22, 23 connected to the upper flanges 12, 13 of the upper frame portion 4 are additionally carried at their projecting ends by the cross-beam 14 which connects the upper flanges 12, 13 to each other.

Each of the slide rails 22, 23 is provided on its underside with an inclined slide face which slopes away in an outward direction. During the displacement of the head pieces 5, 6, the slide rails 22, 23 rest with that sloping slide face on the upper side of those head pieces which is accordingly constructed to be wedge-shaped like the inclined slide face of the slide rails 22, 23.

If the head pieces 5, 6 are displaced from their operating position (FIG. 1) outwards into their opening position (FIG. 2), the wedge-shaped upper side of the head pieces slides along the inclined slide face of the slide rails 22, 23 and thereby lifts the slide rails 22, 23, the cross-beam 14 and the upper flanges 12, 13 slightly (by a few mm). As a result, the friction between the upper flanges 12, 13 and the bearing shoes 15 to 18 is suspended, so that the rollers 1, 2 with their bearing shoes can be easily displaced in the frame and removed from the frame. In the opened state, the frame therefore forms a displacement frame for the roller units.

The inclined slide faces of the slide rails 22, 23 and the correspondingly wedge-shaped upper side of the head pieces 5, 6 are advantageously constructed to be replaceable, so that the height measurement by which the upper flanges 12, 13 are raised during the displacement of the head pieces 5, 6 (or lowered again during the return of the head pieces into the operating position) can be adjusted as required.

In the operating position (FIG. 1), the displaceable head pieces 5, 6 are connected to the lower flanges 9, 10 of the lower frame portion 3 and to the upper flanges 12, 13 of the upper frame portion 4 by locking blocks 25 which produce a closed frame and which introduce the lifting (that is to say, upwardly directed) forces exerted by the rollers 1, 2 on the upper flanges 12, 13 into the lower frame portion 3 via the head pieces. At the same time, the locking blocks 25 position the head pieces 5, 6 centrally in front of the bearing shoes 15, 16.

Provided between the displaceable head pieces 5, 6 and the lower flanges 9, 10 are also locating blocks 26 which, during the displacement of the head pieces from the operating position into the opening position (FIG. 2), cooperate as guide members with the guide 24 constructed in the form of a groove.

All of the force-transmitting faces, especially of the locking blocks 25 and locating blocks 26, are advantageously coated in a corrosion-inhibiting manner.

An electrical drive or a travelling hydraulic system can be used to displace the head pieces 5, 6.

Also indicated in FIG. 2 are the two grinding material guide plates 27 which, in the operating position (FIG. 1), delimit the roller gap at both ends and which, in the opening position (FIG. 2), are pulled upwards to such an extent that they do not obstruct a displacement of the two rollers 1, 2 to the left (that is to say, towards the opened end of the frame).

Whereas, in the embodiment shown, the removal of the roller units from the displacement frame takes place from the side where the fixed roller is located (which is generally the easier solution), it is also possible in the context of the invention to carry out the removal of the roller units from the side where the loose roller is located.

It will generally be advantageous, at one end of the frame, to configure both head pieces to be displaceable in the transverse direction. However, it is in principle also possible according to the invention to construct only one of the two head pieces to be displaceable, the displacement taking place to such an extent that the complete roller units can be removed through the free space created at the end.

The invention claimed is:

1. A roller press having two rollers (1,2) which are rotatably supported in a frame which has a lower frame portion (3), an upper frame portion (4) formed by two upper flanges (12, 13), and, at the two ends of the frame, head pieces (5 to 8) for connecting the upper frame portion to the lower frame portion, the one roller (2) being supported in a non-displaceable manner as a fixed roller and the other roller (1) being displaceable as a loose roller in a direction towards the fixed roller by means of a pressure system and pressure forces occurring during the operation of the roller press being absorbed by the upper and lower frame portions via the head pieces, and at least one head piece (5, 6) being removable from its operating position, while said at least one head piece (5, 6) continues to support the upper flanges (12, 13) of the upper frame portion (4), in order to mount or dismount the rollers, wherein the removable head piece (5, 6) is outwardly displaceable transversely to the upper flanges (12, 13) of the upper frame portion (4) and at the end of the frame that is adjacent to the fixed roller (2), the two head pieces (5, 6) are each outwardly displaceable transversely to the upper flanges (12, 13) of the upper frame portion (4), and in order to reduce the friction occurring between bearing shoes (15 to 18) of the rollers and the frame during displacement of the rollers (1, 2) for the purpose of mounting or dismounting, the upper flanges (12, 13) can be lifted by a displacement of the head pieces (5, 6) outwards.

2. The roller press according to claim 1, wherein the lower and upper frame portions (3, 4) has, at the end of the frame that contains the displaceable head pieces (5, 6), projecting slide rails (20 to 23) for the displaceable head pieces.

3. The roller press according to claim 1, wherein slide rails (20, 21) connected to the lower frame portion (3) have a guide for the displaceable head pieces (5, 6) and upper slide rails (22, 23) connected to the upper flanges (12, 13) of the upper frame portion (4) have an inclined slide face for lifting the upper flanges.

4. The roller press according to claim 3, wherein the upper slide rails (22, 23) rest with their inclined slide face on the displaceable head pieces (5, 6) which are correspondingly wedge-shaped on their upper side.

5. The roller press according to claim 4, wherein the inclined slide faces of the upper slide rails (22, 23) and the correspondingly wedge-shaped upper side of the head pieces (5, 6) are constructed to be replaceable.

6. The roller press according to claim 3, wherein the two upper flanges (12, 13) are connected at the end of the frame that contains the displaceable head pieces (5, 6) by a cross-beam (14) carrying the upper slide rails (22, 23).

7. The roller press according to claim 3, wherein the displaceable head pieces (5, 6) are connected in their operating position to the lower frame portion (3) by locating blocks (26) which cooperate as guide members with the lower slide rails (20, 21) during the displacement of the head pieces out of the operating position.

8. The roller press according to claim 1, wherein the displaceable head pieces (5, 6) are connected in the operating position to the lower and upper frame portions (3, 4) by means of releasable locking blocks (25).

9. The roller press according to claim 3, wherein the slide rails (20, 21) connected to the lower frame portion (3) have a guide for the displaceable head pieces (5, 6) and the upper slide rails (22, 23) connected to the upper flanges (12, 13) of the upper frame portion (4) have an inclined slide face for lifting the upper flanges.

10. The roller press according to claim 9, wherein the upper slide rails (22, 23) rest with their inclined slide face on the displaceable head pieces (5, 6) which are correspondingly wedge-shaped on their upper side.

11. The roller press according to claim 10, wherein the inclined slide faces of the upper slide rails (22, 23) and the correspondingly wedge-shaped upper side of the head pieces (5, 6) are constructed to be replaceable.

12. The roller press according to claim 10, wherein the inclined slide faces of the upper slide rails (22, 23) and the correspondingly wedge-shaped upper side of the head pieces (5, 6) are constructed to be replaceable.

13. The roller press according to claim 9, wherein the two upper flanges (12, 13) are connected at the end of the frame that contains the displaceable head pieces (5, 6) by a cross-beam (14) carrying the upper slide rails (22, 23).

14. The roller press according to claim 9, wherein the displaceable head pieces (5, 6) are connected in their operating position to the lower frame portion (3) by locating blocks (26) which cooperate as guide members with the lower slide rails (20, 21) during the displacement of the head pieces out of the operating position.

* * * * *